US005549202A

United States Patent [19]

Whiteside

[11] Patent Number: 5,549,202

[45] Date of Patent: Aug. 27, 1996

[54] PACKAGING CONTAINER BLANK

[76] Inventor: Michael Whiteside, 70 Springhome Road, Barrie, Canada, L4N 5H8

[21] Appl. No.: 403,847

[22] PCT Filed: Jul. 19, 1994

[86] PCT No.: PCT/CA94/00398

§ 371 Date: May 1, 1995

§ 102(e) Date: May 1, 1995

[87] PCT Pub. No.: WO95/03223

PCT Pub. Date: Feb. 2, 1995

[30] Foreign Application Priority Data

Jul. 20, 1993 [CA] Canada ..... 2100946

[51] Int. Cl.[6] ..... B65D 5/18

[52] U.S. Cl. ..... 206/436; 206/526; 206/597; 53/399; 229/920

[58] Field of Search ..... 206/436, 526, 206/442, 83.5, 597; 53/399; 229/920, 103.2

[56] References Cited

U.S. PATENT DOCUMENTS 1,186,706 6/1916 Swift ..... 206/526
3,163,290 12/1964 Shive ..... 206/526
3,783,579 1/1974 Howe ..... 53/26
4,158,410 6/1979 Novatny ..... 206/597
4,301,922 11/1981 Hamelin et al. ..... 206/597
4,382,511 5/1983 Hamelin et al. ..... 206/597

*Primary Examiner*—Bryon P. Gehman
*Assistant Examiner*—Luan K. Bui
*Attorney, Agent, or Firm*—Fay, Sharpe, Beall, Fagan, Minnich & McKee

[57] ABSTRACT

A blank for forming a U-shaped support envelope for a container package containing rectangular carton containers of uniform height, shape and size, the containers each having a top, a bottom and sides, the U-shaped support envelope having an uncovered top, two opposed uncovered sides, two opposed planar side wall members extending from a planar base, each side wall member having a top edge. Tongue-slot combinations are disposed at the corners of the blank so as to have available cushion tabs for engaging the upper uncovered face of end containers in the package. The tabs extend from slots for engaging a band for holding the containers in the U-shaped envelope.

17 Claims, 7 Drawing Sheets

PACKAGING CONTAINER BLANK

Figure 1:
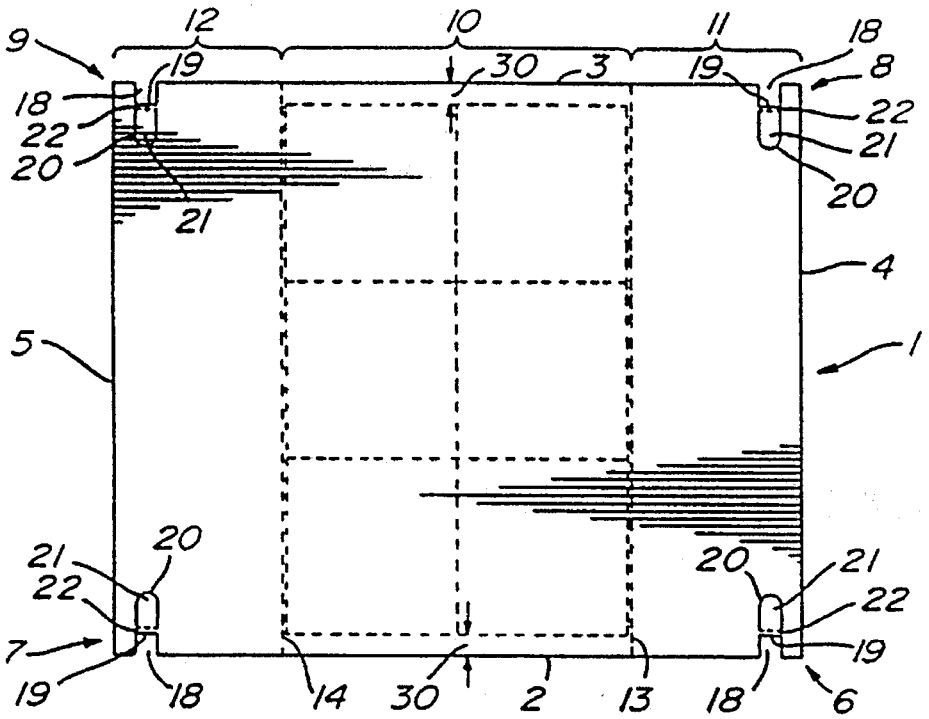

The present invention relates to a container package suitable for containing a plurality of rectangular carton containers of uniform height, shape and size, the containers each having a rectangular cross section from side to side. The present invention in particular relates to multipack type assemblies of rectangular carton containers such as for example, folding cartons for cereal, soap, biscuits, coffee, tea, milk and the like.

It is of major importance to all manufacturers to save money on packaging. It is also a major goal to reduce packaging where possible.

However, any new type of package must be able to flow through the distribution channels undamaged. This is a multi-faceted problem since the new multipack package must endure storage, transportation (i.e. truck or rail), handling in customers distribution, warehouses and finally handling and displaying at the retailer. The manufacturers also must concern themselves with packaging equipment, its cost, availability and proper integration of any new package into their existing packaging and production lines. A further concern of any manufacturer is that the new package must be identified by their customers automatic inventory control bar coding systems (of which there are many).

Packing containers are known which comprise an envelope and wherein the assembly is held together by a strap. One problem still facing the industry however is how to package rectangular fold carton containers such that the containers are not crushed in the strapping process and have sufficient strength to be stored stacked.

It would be advantageous to have an alternate packaging means for packaging rectangular carton containers.

Thus the present invention in accordance with a general aspect provides a blank for forming a U-shaped support envelope for a container package containing rectangular carton containers of uniform height, shape and size, said containers each having a top, a bottom and sides, said U-shaped support envelope having an uncovered top, two opposed uncovered sides, and two opposed, parallel, planar side wall members extending from a planar base, each said side wall member having a top edge, said blank being substantially rectangular and comprising a front edge, a rear edge and two side edges, each side edge defining with the front edge, a front corner each side edge defining with the rear edge, a rear corner a side edge portion of said blank, adjacent each side edge, being foldable upwardly such that said side edge portions each define a respective side wall member, said planar base is connected to each side wall member by a respective fold line, said fold lines are parallel to each other, each said side edge defines the top edge of a respective side wall member, each side wall member comprises a said front corner and a said rear corner, and each of the side wall members has a height such that the top edge thereof is flush with or extends above the tops of the adjacent containers, characterized in that said blank includes tongue-slot combination means disposed at each said corner, each tongue-slot combination means comprising edge slot means for engaging a surrounding band member for holding the carton containers in the U-shaped envelope, said edge slot means thereof being disposed adjacent to a respective side edge of said blank, said edge slot means thereof having a bottom, and cushion tongue means for projecting from said edge slot means, each said tongue-slot combination means being disposed and configured such that when the surrounding band member is positioned in the edge slot means thereof, and is under tension to hold the carton containers in said U-shaped envelope, the uncovered side of an adjacent end container is flush with or extends outwardly beyond the bottom of the slot means thereof, each said tongue-slot combination means being disposed and configured such that when the surrounding band member is positioned in the edge slot means thereof, and is under tension to hold the carton containers in said U-shaped envelope, the band member extends across said uncovered sides of the U-shaped envelope and over and along the side wall members thereof, and each said tongue-slot combination means being disposed and configured such that the cushion tongue means thereof can be positioned so that when the surrounding band member is positioned in the edge slot means thereof, and is under tension to hold the carton containers in said U-shaped envelope, the cushion tongue means thereof is in underlying relation to said band member and engages an upper side edge portion of an uncovered side of a respective adjacent carton container.

In accordance with the present invention, rectangular containers are those which when viewed in cross section from side to side have four corners.

The tongue members projecting from the slots are disposed so as to form radius compressible cushions allowing the strap or band member to pull straight across the uncovered folding carton faces , i.e. the tongues provide resistance against the cartons buckling when strapped. Also strapping the assembled cartons adjacent to their tops establishes extra combined resistance against the cartons buckling when strapped.

The present invention in accordance with another aspect provides a kit for a container package containing rectangular carton containers of uniform height, shape and size, said containers each having a top, a bottom and sides, said kit comprising a blank for forming a U-shaped support envelope, and a surrounding band member for holding the carton containers in said U-shaped support envelope, said U-shaped support envelope having an uncovered top, two opposed uncovered sides, and two opposed, parallel, planar side wall members extending from a planar base, each said side wall member having a top edge, said blank being substantially rectangular and comprising a front edge, a rear edge and two side edges, each side edge defining with the front edge, a front corner each side edge defining with the rear edge, a rear corner a side edge portion of said blank, adjacent each side edge, being foldable upwardly such that said side edge portions each define a respective side wall member, said planar base is connected to each side wall member by a respective fold line, said fold lines are parallel to each other, each said side edge defines the top edge of a respective side wall member, each side wall member comprises a said front corner and a said rear corner, and each of the side wall members has a height such that the top edge thereof is flush with or extends above the tops of the adjacent containers, said kit being characterized in that said blank includes tongue-slot combination means disposed at each said corner, each tongue-slot combination means comprising edge slot means for engaging a surrounding band member for holding the carton containers in the U-shaped envelope, said edge slot means thereof being disposed adjacent to a respective side edge of said blank, said slot means thereof having a bottom and cushion tongue means for projecting from said edge slot means, each said tongue-slot combination means being disposed and configured such that when the surrounding band member is positioned in the edge slot means thereof, and is under tension to hold the carton containers in said U-shaped envelope, the uncovered side of an adjacent end container is flush with or extends outwardly beyond the bottom of the slot means thereof, each said tongue-slot combination means being disposed and configured such that when the surrounding band member is positioned in the edge slot means thereof, and is under tension to hold the carton containers in said U-shaped envelope, the band member extends across said uncovered sides of the U-shaped envelope and over and along the side wall members thereof, and each said tongue-slot combination member being disposed and configured such that the cushion tongue means thereof can be positioned so that when the surrounding band means is positioned in the edge slot means thereof, and is under tension to hold the carton containers in said U-shaped envelope, the cushion tongue means thereof is in underlying relation to said band member and engages an upper side edge portion of an uncovered side of a respective adjacent carton container.

In accordance with the present invention the blank may be made of any suitable material which can maintain the integrity of the container package, i.e. is strong and solid enough (e.g. stiff) to support the carton containers in the container package.

Preferably, however, in accordance with the present invention, each side edge portion may be a corrugated member comprising a plurality of parallel corrugation flutes, said flutes being disposed such that when a side edge portion is folded upwardly the flutes thereof extend from a respective fold line to a respective said top edge.

In accordance with the present invention the entire blank may be of corrugated cardboard comprising a plurality of parallel corrugation flutes, said flutes being disposed such that they extend from one said side edge to the other said side edge, said flutes being disposed such that when the side edge portions are folded upwardly the flutes thereof extend from a respective fold line to a respective said top edge orthogonally with respect to the respective fold line.

Instead of a blank made of a paperboard, a blank may be used which is a corrugated board made of any other suitable material such as for example a synthetic plastics material.

Additionally, if desired, only the side edge portions of the blank may be corrugated while the central base portion may, for example, be of some suitable non-corrugated paperboard or of some suitable non-corrugated synthetic material.

The present invention in accordance with a further aspect provides a container package comprising a U-shaped support envelope, a plurality of rectangular carton containers, and a surrounding band member, said plurality of rectangular carton containers being of uniform height, shape and size, said containers each having a top, a bottom and sides, said U-shaped support envelope having an uncovered top, two opposed uncovered sides, and two opposed, parallel, planar side wall members extending upwardly from a planar base, each said side wall member having a top edge, said carton containers being arranged in said U-shaped envelope in juxtaposed upright manner, in a plurality of parallel rows parallel to the said wall members and in a plurality of parallel rows orthogonal to the said side wall members, each side wall member abutting an adjacent row of said carton containers parallel thereto, each row of said carton containers, extending parallel to the side wall members, having a pair of end containers each of which has an uncovered side, said surrounding band member being held under tension and extending across said uncovered sides of the end carton containers and over and along said side wall members, the band holding the carton containers in the U-shaped envelope, characterized in that said U-shaped envelope comprises a front edge, a rear edge and two top edges, each top edge defining with the front edge a front corner each top edge defining with the rear edge a rear corner each side wall member comprises a said top edge, a said front corner and a said rear corner, each of the side wall members has a height such that the top edge thereof is flush with or extends above the tops of the adjacent containers, preferably, each side wall member being a corrugated member comprising a plurality of parallel corrugation flutes extending upwardly from the base to a respective top edge of the side wall member, said U-shaped envelope including a tongue-slot combination means disposed at each said corner of the side wall members, each tongue-slot combination means comprising edge slot means engaging said band member, said edge slot means being disposed adjacent to a respective side edge, said edge slot means thereof having a bottom, and cushion tongue means projecting from said edge slot means and engaging an upper side edge portion of an uncovered side of a respective adjacent carton container, each said cushion tongue means being in underlying relation to said band member, and the uncovered side of each end container adjacent to a respective slot means is flush with or extends outwardly beyond the bottom of said slot means.

In accordance with the present invention, the U-shaped envelope of the container package may be of a corrugated material (e.g. cardboard) and the base may also comprise a plurality of parallel corrugation flutes, said flutes being disposed such that they extend from one said side wall member to the other said side wall member.

In accordance with the present invention the tongue-slot combination means may take on any suitable configuration for overlapping a respective edge portion of an uncovered side of a carton container with a cushion tongue means.

Thus in accordance with one example embodiment the tongue-slot combination means may be one wherein each said tongue-slot combination means disposed at a front corner is defined by a pair of opposed cuts in the blank or in the side wall member, said cuts extending from the front edge, adjacent to a respective side edge, wherein each said tongue-slot combination means disposed at a rear corner is defined by a pair of opposed cuts in the blank or in the side wall member, said cuts extending from the rear edge, adjacent to a respective side edge, wherein said slot means has two opposed side edges extending from the bottom thereof, wherein said tongue means has two opposed side edges, wherein each said pair of opposed cuts define the side edges of both the tongue means and the slot means, and wherein the tongue means is foldable such that when the surrounding band member is positioned in the slot means and is under tension to hold the carton containers in said U-shaped envelope, the tongue means projects from the slot means in underlying relation to said band member, the tongue means engages an upper side edge portion of an uncovered side of a respective adjacent carton container and the tongue means is connected to the bottom of the slot means by a fold line.

In accordance with another example embodiment the tongue-slot combination means may be one wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means is defined by a cut in the blank or in the side wall member, said cut being configured such that the tongue means is attached to the blank or the side wall member by a root member, said cut and root member being configured such that the tongue means is registrable with the slot means, and wherein said tongue means is foldable such that when the surrounding band member is positioned in the slot and is under tension to hold the carton containers in said U-shaped envelope, the tongue means is folded around the root member over the bottom of the slot means, the tongue means projects from the slot means in underlying relation to said band member, and the tongue means engages an upper side edge portion of an uncovered side of a respective adjacent carton container.

In accordance with a further example embodiment the tongue-slot combination means may be one wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means comprises an elongated member attached to the blank or to the side wall member, wherein said elongated member is disposed and configured so as to have an end portion registrable with the slot means, and wherein said elongated member is foldable such that when the surrounding band member is positioned in the slot and is under tension to hold the carton containers in said U-shaped envelope, the end portion of the elongated member is folded over the bottom of the slot means, the end portion of the elongated member projects from the slot means in underlying relation to said band member, and the end portion of the elongated member engages an upper side edge portion of an uncovered side of a respective adjacent carton container.

The packaging system as provided herein can be adapted without difficulty either from standard equipment or singly newly designed equipment. Thus a series of rectangular folding cartons are assembled easily in patterns suitable to be sold i.e. 12-24-36 etc. Thus, for example a U-shaped corrugated blank with the special designed strapping slots herein may be placed over the cartons to be packaged and the entire assembly may flow through an horizontal strapping machine which secures the assembly by means of a strap.

A further advantage of the present invention is that the blank may consists of a pre-formed corrugated tray with special design side walls and special designed strapping slots that can also be strapped as above. Packages are generally drop packed in this style of container. A plastic strap may thus, for example, be pulled through the slots of the tongue-slot combination of the present invention around the entire circumference of the U-shaped envelope formed from the starting corrugated blank and the assembled rectangular packages or cartons and then sealed after being positioned to bring the entire assembly tightly together, In accordance with the present invention the top edge of a side member of the U-shaped envelope is more or less at least the same height as (i.e. level with) the top of the containers or somewhat higher than the top of the containers; the purpose of the top edges being to participate as load bearing members which bear all or a substantial part of the load when the packages are stacked on top of each other so as to inhibit crushing of the carton containers. The other feature of the package system herein namely the vertical corrugations of side wall members means that when a multipack is tightly strapped, the total unitized package gains tremendous strength.

In accordance with the present invention, as mentioned above, the uncovered side of an adjacent end container is flush with or extends outwardly beyond the bottom of the respective slot means, i.e. the uncovered side face of an end container is positionable in relation to the uncovered sides of the U-shaped envelope (i.e. orthogonally with respect to the respective side wall member) over a distance extending between the bottom of the adjacent slot means and the open mouth thereof but cannot of course extend beyond the mouth of the slot means since the purpose of the slot means is to engage the band member.

The blank apart for the slots which may be present may if desired have no other perforations; alternatively, the blank, to further reduce the weight, may have a plurality of holes provided that the holes do not interfere with the ability of the U-shaped envelope to retain the containers when strapped.

Figure 2:
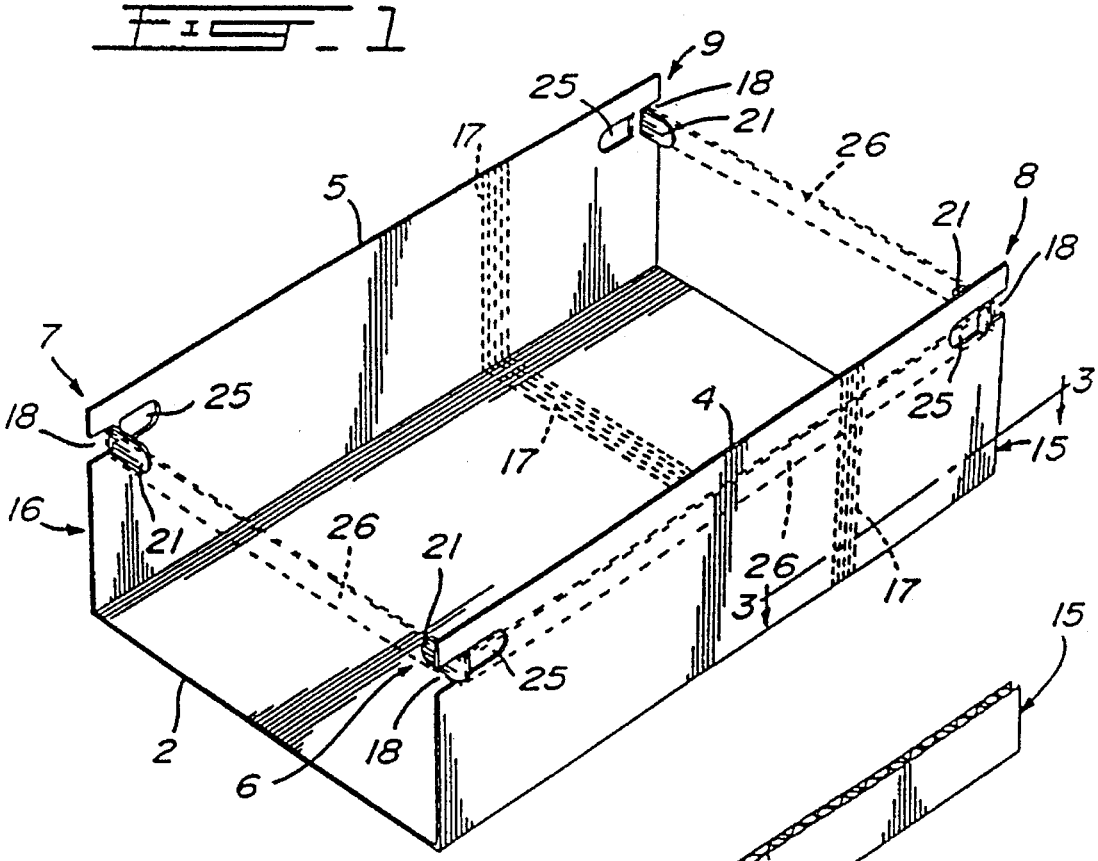
Figure 3:
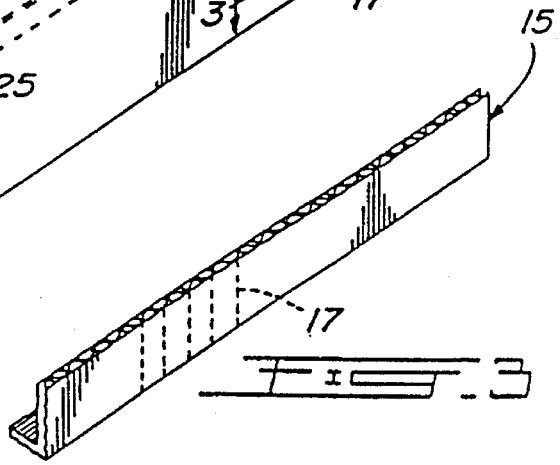
Figure 5:
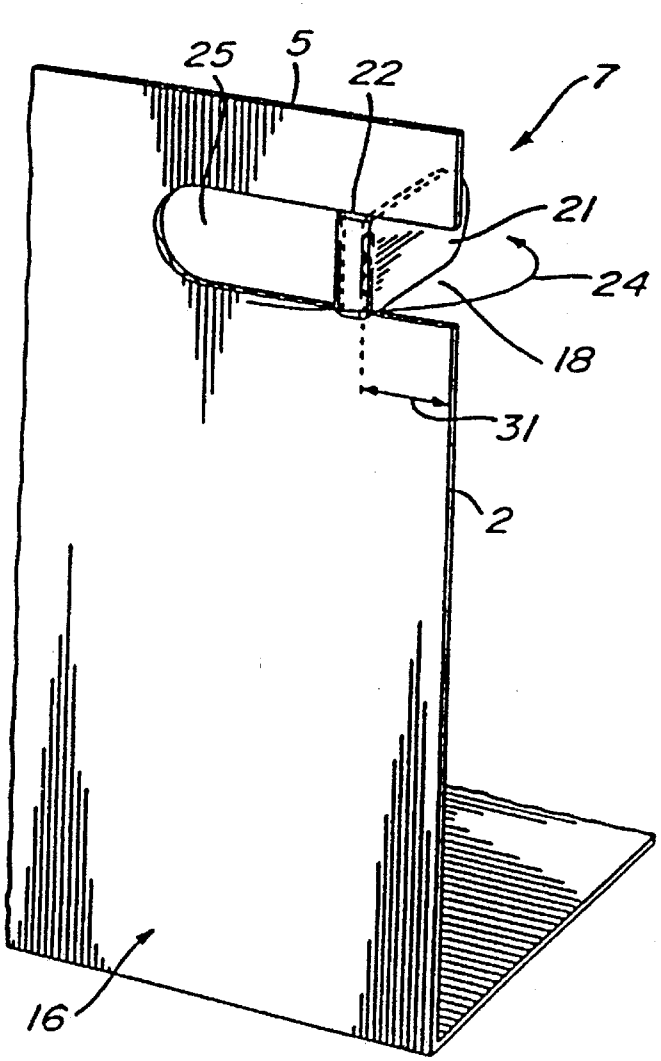
Figure 4:
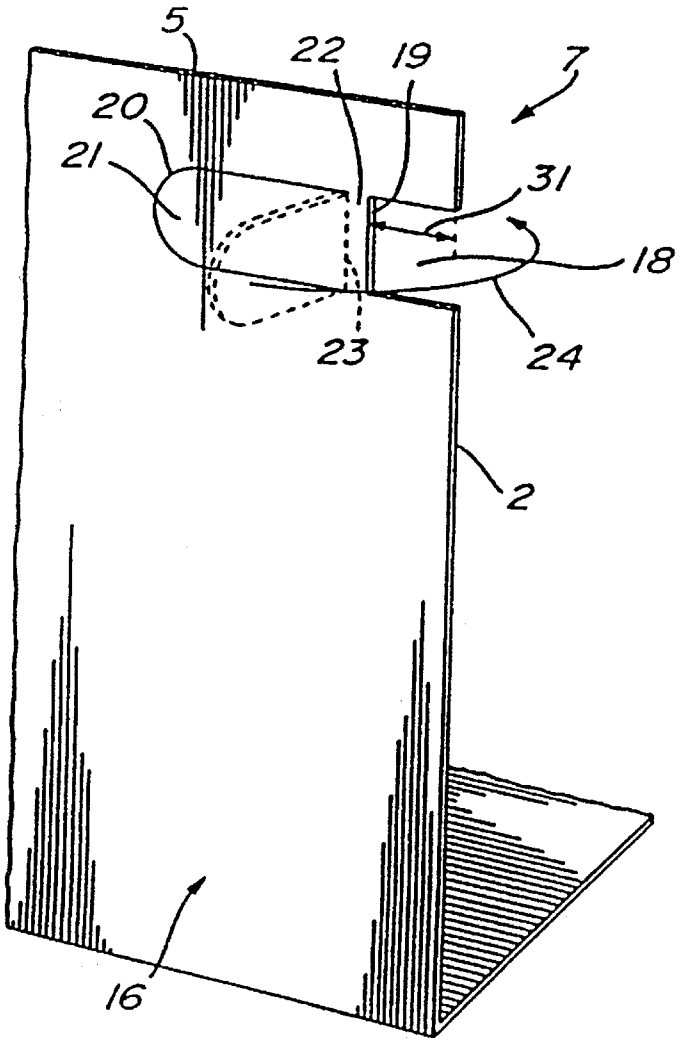
Figure 6:
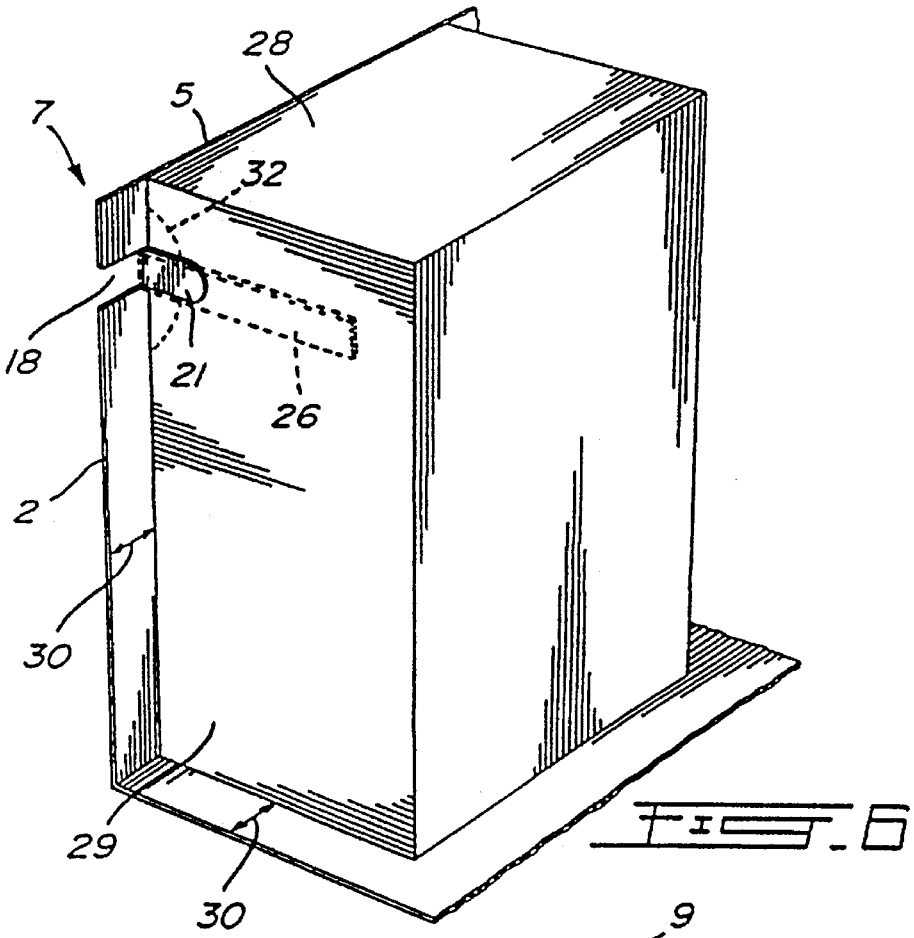
Figure 7:
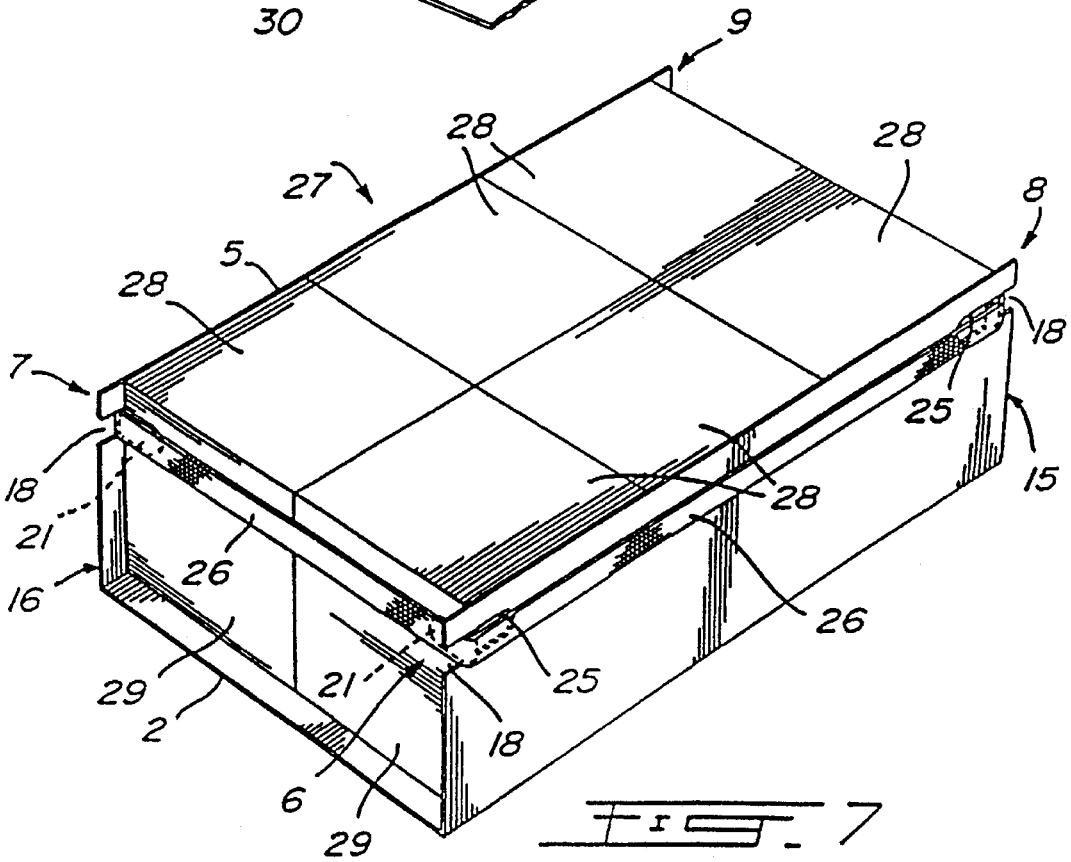
Figure 8:
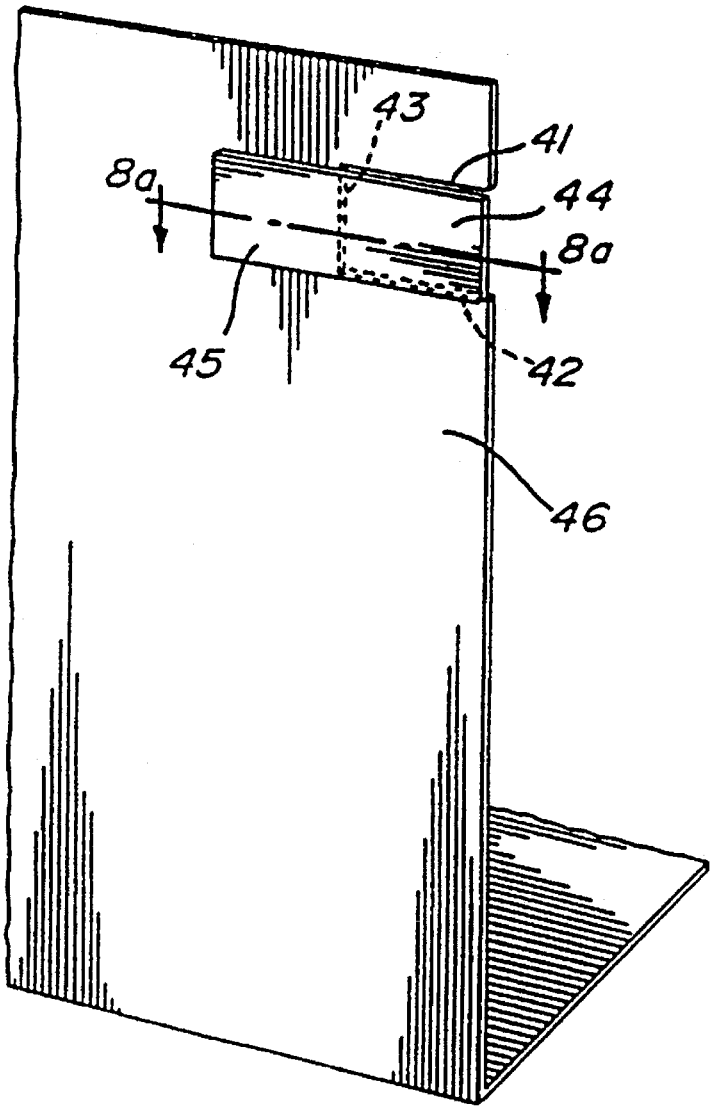
Figure 8A:
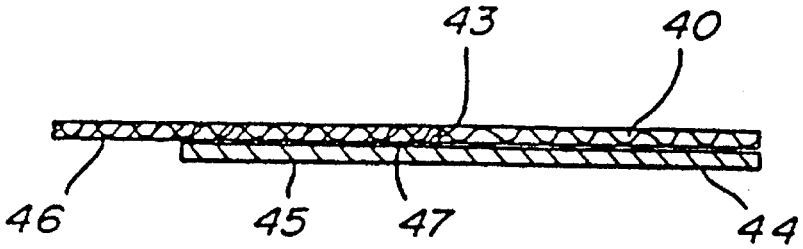
Figure 10:
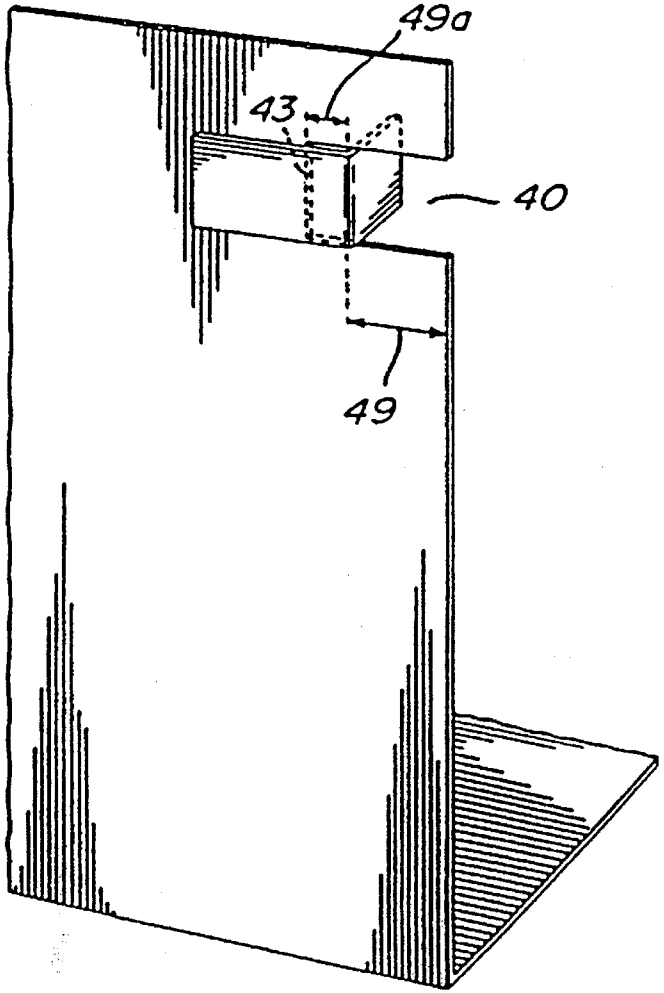
Figure 9:
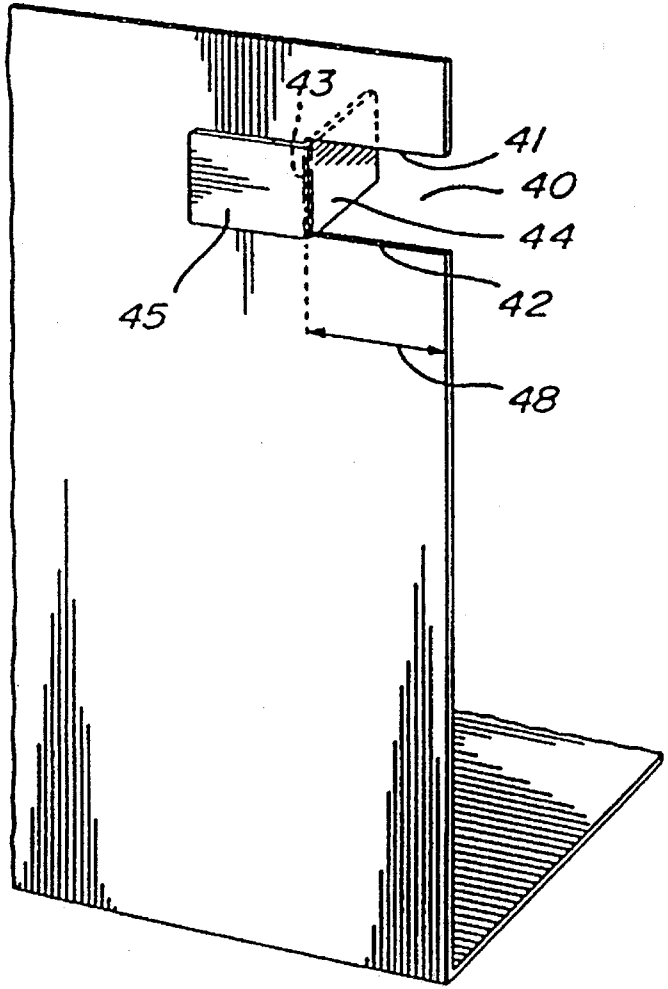
Figure 12:
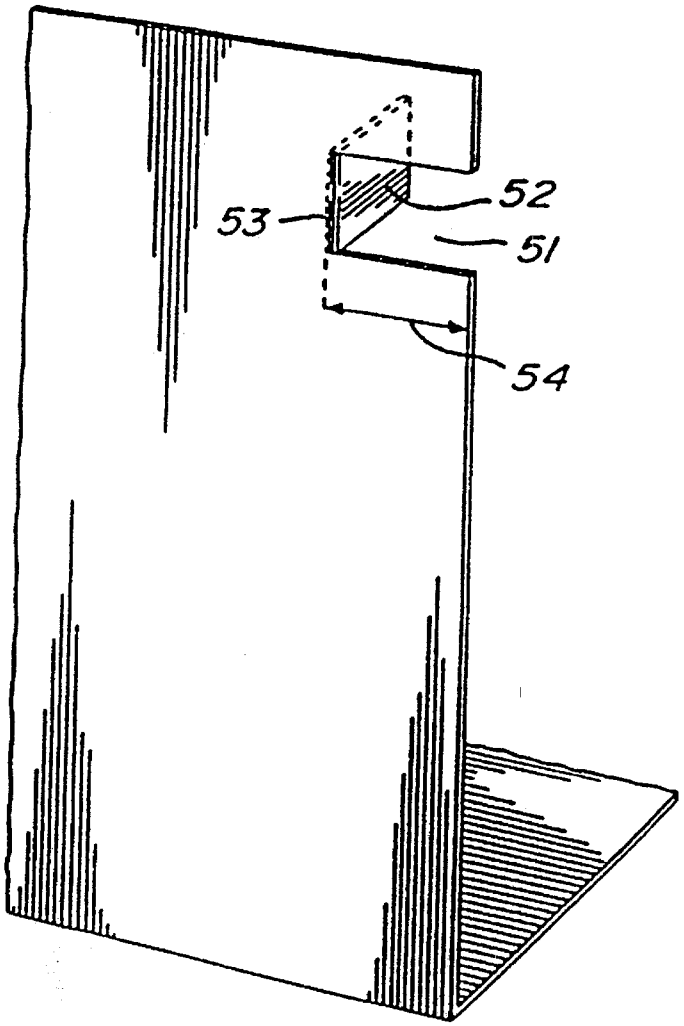
Figure 11:
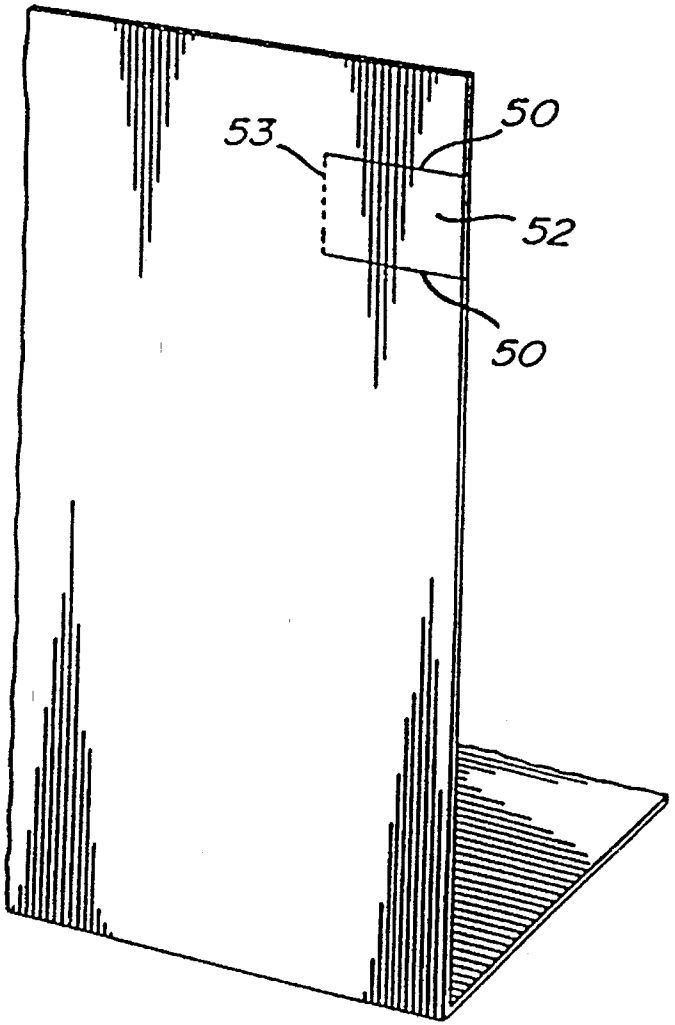
Figure 14:
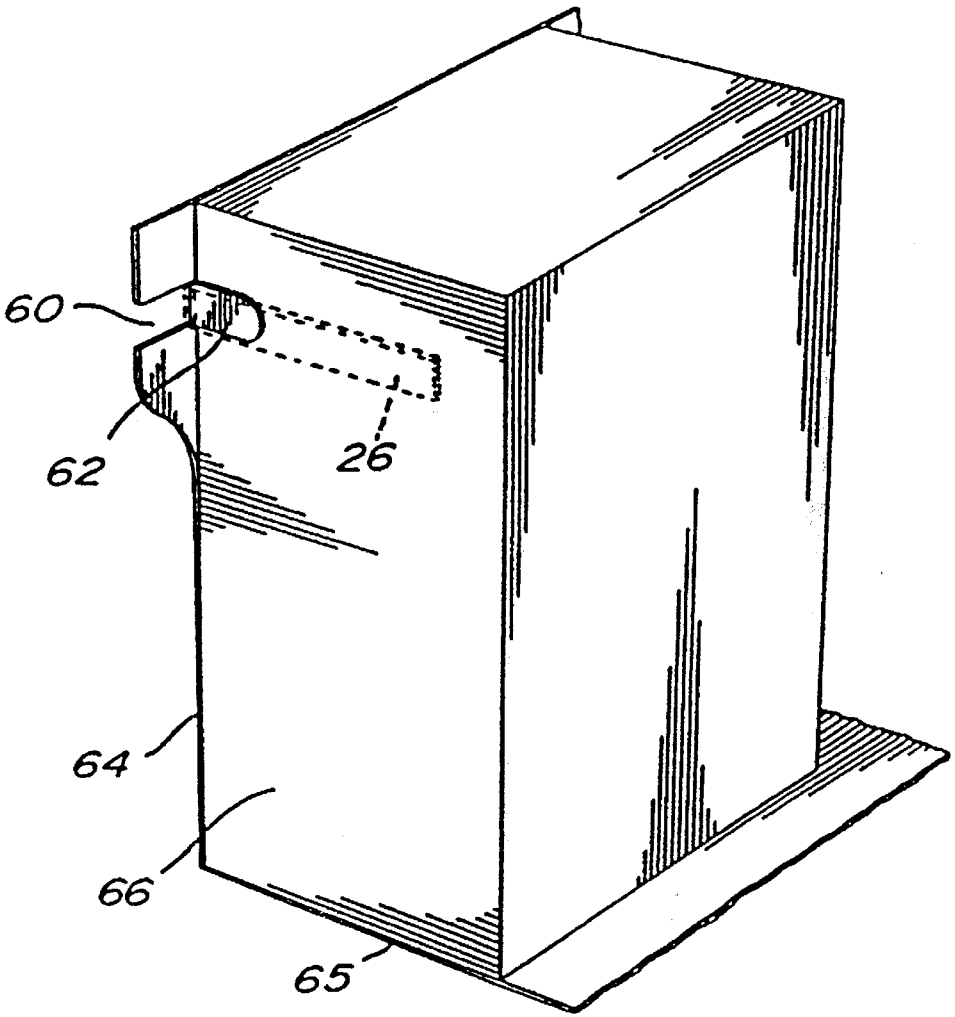
Figure 13:
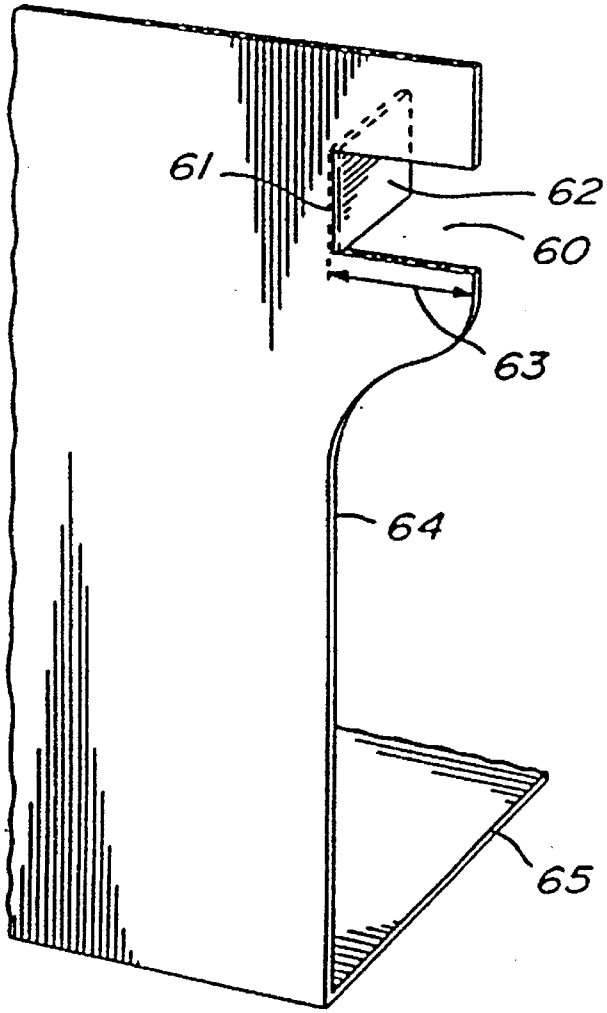

In drawings which illustrate example embodiments of the present invention,

FIG. 1 is a plan view of an embodiment of a corrugated cardboard blank for forming a U-shaped envelope for a container package for carton containers, FIG. 2 is a perspective view of a U-shaped envelope formed from the blank shown in FIG. 1, FIG. 3 is a cross section view of a side member of the envelope shown in FIG. 2 along 3—3, FIG. 4 is a partial enlarged perspective view of the U-shaped envelope shown in FIG. 2, the view showing the tongue-slot means at the upper corner of a side member thereof, FIG. 5 is another partial enlarged perspective view of the U-shaped envelope shown in FIG. 2, the view showing the tongue-slot means at the upper corner of a side member thereof with the tongue means wrapped around the root member covering the bottom of the slot means FIG. 6 is a partial enlarged perspective view of the U-shaped envelope shown in FIG. 2, the view showing the tongue-slot means at the upper corner of a side member thereof with the tongue means engaging an upper side edge portion of the uncovered side of a carton container, FIG. 7 is a perspective view of a container package incorporating the U-shaped envelope formed form the blank shown in FIG. 1, FIG. 8 is a partial enlarged perspective view showing another embodiment of the tongue-slot means at the upper corner of a side member, the tongue means comprising an elongated member, FIG. 8*a* is a cross section along 8*a*—8*a* of FIG. 8 showing the elongated member as fixed to the outer surface of the side wall member, FIG. 9 is another partial enlarged perspective view of the embodiment shown in FIG. 8, the view showing the tongue-slot means at the upper corner of a side member thereof with the elongated member folded so as to cover the bottom of the slot means, FIG. 10 is another partial enlarged perspective view of the embodiment shown in FIG. 8, the view showing the tongue-slot means at the upper corner of a side member thereof with the elongated member folded so as to cover the bottom of the slot means but with the elongated member spaced apart from the bottom of the slot means, FIG. 11 is a partial enlarged perspective view showing further embodiment of the tongue-slot means at the upper corner of a side member, the tongue means comprising a tab connected to the bottom of the slot means, FIG. 12 is another partial enlarged perspective view of the embodiment shown in FIG. 11, the view showing the tongue-slot means at the upper corner of a side member thereof with tab folded such that the fold line defines the bottom of the slot means, FIG. 13 is a partial enlarged perspective view showing a further example embodiment of the tongue-slot means at the upper corner of a side member, the tongue means comprising a tab connected to the bottom of the slot means, and FIG. 14 is a partial enlarged perspective view of tongue slot means of FIG. 13, the view showing the tongue-slot means at the upper corner of a side member with the tongue means engaging an upper side edge portion of the uncovered side of a carton container.

Referring to FIG. 1, a corrugated cardboard blank 1 is shown for forming a U-shaped envelope. The blank 1 has a front edge 2, a rear edge 3 and two side edges 4 and 5. The front edge 2 defines with each of the side edges 4 and 5, front corners 6 and 7; similarly the rear edge 3 forms with each of the side edges 4 and 5, rear corners 8 and 9.

The central portion 10 is the base upon which the rectangular carton containers are to be arranged in juxtaposed upstanding manner. In FIG. 1 these rectangular containers are indicated generally by the broken lines.

The blank 1 also has side edge portions 11 and 12. These side edge portions can be folded upwardly along the fold lines 13 and 14, so as to define respective side wall members 15 and 16 of a U-shaped envelope as shown in FIG. 2; the fold lines 13 and 14 are shown as dotted lines in FIG. 1. As may be seen from FIG. 2 when the side portions 11 and 12 are folded upward the side edges 4 and 5 define the top edges of the side wall members 15 and 16.

The blank may be provided with a fold indentation or shallow cut (following the fold lines mentioned above) to facilitate folding; alternatively these fold aids need not be present, e.g. if the packaging machinery includes appropriately configured folding means. If desired, other members of the blank which are to be folded may be provided with such aids.

For each of the side edge portions 11 and 12, the distance between side edges 4 and 5 and the respective fold lines 13 and 14 is such that the top edges of the respective side wall members 15 and 16 are flush with the tops of the carton containers (see FIGS. 6 and 7); this distance can be greater than the height of the carton containers but not smaller since, for this example embodiment, the side wall members are intended to be load bearing members for inhibiting the application of vertical loads on the containers which may crush or otherwise damage the containers.

The blank 1 is of a corrugated cardboard comprising a plurality of parallel corrugation flutes. Some of the flutes are shown in FIG. 2 as being represented by the dotted lines 17; the flutes are disposed orthogonally (i.e. at right angles) to the fold lines 13 and 14 for both the base and the side wall members. The disposition of the flutes in this way enhances the strength of the side wall members so as to facilitate stacking of container packages incorporating the blank in the form of a U-shaped envelope as described herein. The flutes 17 are shown in cross section in FIG. 3.

The blank 1 is provided at each of the corners 6, 7, 8 and 9 with identical tongue-slot means; since the tongue-slot means are identical the same reference numerals will be used to designate the common parts thereof.

Still referring to FIG. 1, each of the tongue-slot means comprises an edge slot 18 disposed adjacent to a respective side edge of the blank 1. The edge slot 18 has a bottom 19 and two parallel opposed side edges which extend from the bottom 19 to a respect front or rear edge of the blank as the case may be; i.e. the edge slots 18 have a U-shape. The opposed edges of an edge slot 18 are also more or less parallel to a respective adjacent side of the blank.

Each of the tongue-slot means has cushion tongue means defined by a cut 20 in the blank. The cut 20 is U-shaped such that the tongue means or tab 21 defined thereby is attached to the blank by a stem or root member 22. The stem member 22 spaces apart the slot 18 and the tab 21.

Referring to FIGS. 4 and 5, the tab 21 is configured and disposed such that it can register with the slot 18. The tab 21 can thus be pushed out of the blank 1 and folded about fold line 23 (dotted line) in the direction of the arrow 24; with the tab pushed out an opening 25 is exposed in the blank 1. The pushed out tab 21 is shown in dotted outline in FIG. 4.

Referring in particular to FIG. 5 the tab 21 can in this way be wrapped about the stem member 22 so as to cover the bottom 19 of the slot and project from the slot 18 transversely with respect to a respective side member into the interior of the U-shaped envelope. FIG. 2 shows all four tabs 21, disposed adjacent the top edges 4 and 5, wrapped about their respective stem members 22; the position of the band 26 which is used to hold the containers in the container package is shown in dotted lines. As can be appreciated when the band 26 holds the carton containers in place it extends across each of the uncovered sides of the U-shaped envelope as well as along and over the side wall members thereof; see FIG. 7 as well.

Referring to FIG. 7 the blank 1 is configured and sized to be used as part of a container package 27 for containing a plurality of rectangular carton containers. The cartons are rectangular in the sense that when viewed in cross section from side to side they have four corners. In the present particular example they are of more or less uniform rectangular cross section from top to bottom; these containers are all of uniform height, shape and size; the faces may be planar. The tops of the containers, which are designated with the reference numeral 28, have a rectangular periphery; the containers also have bottoms and sides with rectangular peripheries.

As can be seen, the containers are arranged in two rows of three containers each which are parallel to and abut the side wall members 15 and 16; the containers are also arranged in three parallel rows of two containers each which are disposed orthogonally with respect to the side members 15 and 16. The two end containers at each of the opposed ends of the three container rows, at the uncovered sides of the U-shaped envelope, each have an uncovered side 29 (only two uncovered sides 29 are shown in FIG. 7 the other opposite pair being hidden from view behind the containers).

As seen from FIG. 6 and 7 the uncovered sides 29 are spaced a certain distance from the front and rear edges (2, 3); the spacing distance is shown by the arrows 30 in FIGS. 1 and 6 with respect to the front edge (a similar spacing is provided with respect to the rear edge). The distance 30 in the embodiments shown in FIGS. 1 to 7 corresponds to the depth of the slots 18 which depth is shown by the arrow 31 in FIGS. 4 and 5, i.e. the distance 30 more or less corresponds or is equal to the distance 31 from the edge 2 to the bottom 19 of the slot 18. In other words the uncovered surfaces 29, adjacent the slots 18, on both sides of the package 27 are flush with the bottoms of the front and rear slots 18. The distance 30 may be shorter than the depth distance 31 (as shall be described with respect to FIG. 10 in relation to an alternate tongue-slot embodiment) but it cannot be significantly longer; if the distance 30 was significantly longer than the distance 31, the tightening of the band member 26 about the U-shaped envelope to strap the containers therein would tear or rip the stem member and damage not only the side wall member but possibly also the edge portion of the adjacent container; see FIG. 6 wherein the edge portion which may be damaged is outlined by dotted line 32. In any event, the band 26 is tightened sufficiently to hold the containers in place without squashing the corner edges 32 underlying the tabs 21 FIG. 6).

It is of course to be understood that a blank is to be configured and sized in relation to the size and number of containers to be held by the finished container package such that the uncovered surfaces of the end containers are at least flush with the bottoms of the slot means and similarly the top edges of the side wall members are at least flush with the tops of the containers. The package may for example include 12, 24, 30 containers, etc. as the case may be; the containers may be of different rectangular shape than shown in the figures.

Referring to FIGS. 1, 2 and 6, the package 27 may be formed by providing a blank 1; folding the side edge portions 11 and 12 upwardly along fold lines 13 and 14 to define the side wall members 15 and 16; wrapping the tabs 21 around the stems 22 through the slots 18; placing the rectangular carton containers in the U-shaped envelope onto the base portion 10; placing the band 26 in the slots 10 such that the band overlies the tabs 21 projecting from the slots 18 and the tabs 21 overly an upper edge portion of an uncovered side 29 of an adjacent carton container; and tightening and fixing the band member in any usual known manner so as to place the band member under tension for holding the containers in the package.

The tab members 21 folded through the slots 18 form radius compressible cushions allowing the strap or band member 26 to pull straight across the folding carton faces 29, i.e. the tabs provide resistance against the cartons buckling when strapped. Also strapping the assembled cartons adjacent to their tops establishes extra combined resistance against the cartons buckling when strapped.

The package 27 with the folding carton containers and the vertical corrugated flutes forms a very strong platform unit for vertical top load, i.e. stacking of a plurality of packages.

If desired, in order to increase the resistance of the package to unwanted displacement of the containers between the open ends of the U-shaped envelope, a small lip may be provided at the base. The lip may be formed by making two parallel cuts in the blank along the fold lines 13 and 14 a distance about equal to the distance shown by the arrow 30 in FIG. 6. Two other cuts may be made adjacent and parallel to each of these cuts along the fold lines; these two other cuts being made in the respective edge portions 11 and 12 a relatively short distance equal to that of the cuts made along the fold lines. The first two cuts define a lip which is attached to the base and the other two cuts define support tabs each attached to a respective side wall member. Once the containers are held in place the lips can be folded up to abut the base of the uncovered faces of the end containers; thereafter the two support tabs are folded inwardly and glued to the lip. Once in place this lower lip will help inhibit lateral movement of the containers in the package.

FIGS. 8, 9 and 10 illustrate another example tongue-slot arrangement in accordance with the present invention. The tongue slot-combination includes a slot 40 which has two parallel opposed side edges 41 and 42 and a bottom 43 (the bottom 43 is shown in dotted outline); the slots may be die cut when forming the blank 1 which may also be die cut from a corrugated sheet. The tongue means comprises an elongated member which has a front portion 44 and a rear portion 45.

The rear portion of the elongated member as shown in FIG. 8*a* is fixed to the outer surface of the side wall member 46 by a layer 47 of any suitable type of adhesive or glue such that the elongated member is integral with the side wall member. The use of such an elongated member provides additional strength to the side wall member for inhibiting the strap or band member 26 from tearing through the side wall member.

As seen from FIG. 9 the front portion 44 of the elongated member is configured such that it can register with the slot 40. Thus the front portion 44 can be folded through the slot 40 such that it covers the bottom 43 of the slot and projects inwardly from the slot 40 into the U-shaped envelope. With the front portions 44 projecting into the U-shaped envelope a package container may be made in the same way as described above with respect to FIGS. 1 to 7. In this case the uncovered sides of the containers are flush with the bottoms 43 of the slots 40 such that the uncovered sides are spaced a distance from the front or rear edge indicated by the arrow 48 (FIG. 9). Alternatively, the uncovered sides may be spaced a lesser distance such as represented by the arrow 49 (FIG. 10); the containers may not of course extend beyond the mouth of a slot 40 since the purpose of a slot 40 is to engage the band member 26. In this latter case the front portion 44 is folded such that while it covers the bottom 43, it is spaced a distance from the bottom 43 shown by the arrow 49*a*; this spacing can provide a safety margin inhibiting tearing of the side wall due to inadvertent over tensioning of the band, i.e. by providing some play.

The rear portion 45 of the elongated member alternatively may be fixed to the inner face of the side wall member, (i.e. in the assembled package the rear portion is sandwiched between the side wall member and the adjacent carton container) provided that this disposition of the rear portion does not substantially interfere with the cushioning effect of the tongue means. The inner face of the side wall member immediately behind the bottom 43 of the slot 40 may, for example, be provided with a recess for seating the rear portion of the elongated member such that the rear portion is flush with the inner face of the side wall member. In this case, as with respect to the other embodiments mentioned above the uncovered side face of the containers are to be at least flush with the bottom of the slots in the final package.

FIGS. 11 and 12 show another alternate tongue-slot combination means. The combination is defined by two opposed parallel cuts 50 in the side wall member. These cuts 50 define the opposed side edges of the slot 51 and the tab 52; the tab is connected to the bottom of the slot, the bottom of the slot 51 being defined by the fold line 53 once the tab 52 is folded out of the slot 51. In this case the uncovered sides of the containers are to be flush with the bottoms 53 of the slots 51 such that the uncovered sides are spaced a distance from the front or rear edge indicated by the arrow 54 (FIG. 12). This type of system however has been found to be successful usually only with very light products, i.e. tea.

FIGS. 13 and 14 show a yet further example embodiment of the tongue-slot combination means of the present invention. This embodiment is similar to the embodiment shown in FIG. 11 and 12 in that the tongue-slot combination means is defined by cuts in the side wall member. The combination has a slot 60 provided with a bottom 61 defined by a fold line once the tab 62 is fold out of the slot the tab 62 is connected to the bottom along the fold line. The slot has a depth indicated by the arrow 63. However a portion 64 of the front or rear edge of the side wall member below the tongue-slot combination means as well as the front or rear edge 65 of the base portion of the envelope are recessed with respect to the tongue-slot combination means such that these edges are flush with the bottom 61 of the slot 60. Thus for an assembled package as partially shown in FIG. 14 not only is the top of the container(s) flush with the top edge of the side wall members but the exposed uncovered side face of the end containers is flush with the side edge portion 64 and the edge 65 of the base.

I claim:

1. A blank for forming a U-shaped support envelope for a container package containing rectangular carton containers of uniform height, shape and size, said containers each having a top, a bottom and sides, said U-shaped support envelope having an uncovered top, two opposed uncovered sides, and two opposed, parallel, planar side wall members extending from a planar base, each said side wall member having a top edge, said blank being substantially rectangular and comprising a front edge, a rear edge and two side edges, each side edge defining with the front edge, a front corner each side edge defining with the rear edge, a rear corner a side edge portion of said blank, adjacent each side edge, being foldable upwardly such that said side edge portions each define a respective side wall member, said planar base is connected to each side wall member by a respective fold line, said fold lines are parallel to each other, each said side edge defines the top edge of a respective side wall member, each side wall member comprises a said front corner and a said rear corner, and each of the side wall members has a height such that the top edge thereof is flush with or extends above the tops of the adjacent containers, characterized in that each side edge portion is a corrugated member comprising a plurality of parallel corrugation flutes, said flutes being disposed such that when a side edge portion is folded upwardly the flutes thereof extend from a respective fold line to a respective said top edge, and said blank includes tongue-slot combination means disposed at each said corner, each tongue-slot combination means comprising edge slot means for engaging a surrounding band member for holding the carton containers in the U-shaped envelope, said edge slot means thereof being disposed adjacent to a respective side edge of said blank, said edge slot means thereof having a bottom, and cushion tongue means for projecting from said edge slot means, each said tongue-slot combination means being disposed and configured such that when the surrounding band member is positioned in the edge slot means thereof, and is under tension to hold the carton containers in said U-shaped envelope, the uncovered side of an adjacent end container is flush with or extends outwardly beyond the bottom of the slot means thereof, each said tongue-slot combination means being disposed and configured such that when the surrounding band member is positioned in the edge slot means thereof, and is under tension to hold the carton containers in said U-shaped envelope, the band member extends across said uncovered sides of the U-shaped envelope and over and along the side wall members thereof, and each said tongue-slot combination means being disposed and configured such that the cushion tongue means thereof can be positioned so that when the surrounding band member is positioned in the edge slot means thereof, and is under tension to hold the carton containers in said U-shaped envelope, the cushion tongue means thereof is in underlying relation to said band member and engages an upper side edge portion of an uncovered side of a respective adjacent carton container.

2. A blank as defined in claim 1 wherein the blank is of corrugated cardboard comprising a plurality of parallel corrugation flutes, said flutes being disposed such that they extend from one said side edge to the other said side edge, said flutes being disposed such that when the side edge portions are folded upwardly the flutes thereof extend from a respective fold line to a respective said top edge orthogonally with respect to the respective fold line.

3. A blank as defined in claim 1 wherein each said tongue-slot combination means disposed at a front corner is defined by a pair of opposed cuts in the blank, said cuts extending from the front edge, adjacent to a respective side edge, wherein each said tongue-slot combination means disposed at a rear corner is defined by a pair of opposed cuts in the blank, said cuts extending from the rear edge, adjacent to a respective side edge, wherein said slot means has two opposed side edges extending from the bottom thereof, wherein said tongue means has two opposed side edges, wherein each said pair of opposed cuts define the side edges of both the tongue means and the slot means, and wherein the tongue means is foldable such that when the surrounding band member is positioned in the slot means and is under tension to hold the carton containers in said U-shaped envelope, the tongue means projects from the slot means in underlying relation to said band member, the tongue means engages an upper side edge portion of an uncovered side of a respective adjacent carton container and the tongue means is connected to the bottom of the slot means by a fold line.

4. A blank as defined in claim 1 wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means is defined by a cut in the blank, said cut being configured such that the tongue means is attached to the blank by a root member, said cut and root member being configured such that the tongue means is registrable with the slot means, and wherein said tongue means is foldable such that when the surrounding band member is positioned in the slot and is under tension to hold the carton containers in said U-shaped envelope, the tongue means is folded around the root member over the bottom of the slot means, the tongue means projects from the slot means in underlying relation to said band member, and the tongue means engages an upper side edge portion of an uncovered side of a respective adjacent carton container.

5. A blank as defined in claim 1 wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means comprises an elongated member attached to the blank, wherein said elongated member disposed and configured so as to have an end portion registrable with the slot means, and wherein said elongated member is foldable such that when the surrounding band member is positioned in the slot and is under tension to hold the carton containers in said U-shaped envelope, the end portion of the elongated member is folded over the bottom of the slot means, the end portion of the elongated member projects from the slot means in underlying relation to said band member, and the end portion of the elongated member engages an upper side edge portion of an uncovered side of a respective adjacent carton container.

6. A kit for a container package containing rectangular carton containers of uniform height, shape and size, said containers each having a top, a bottom and sides, said kit comprising a blank for forming a U-shaped support envelope, and surrounding band means for holding the canon containers in said U-shaped support envelope, said U-shaped support envelope having an uncovered top, two opposed uncovered sides, and two opposed, parallel, planar side wall members extending from a planar base, each said side wall member having a top edge, said blank being substantially rectangular and comprising a front edge, a rear edge and two side edges, each side edge defining with the front edge, a front corner each side edge defining with the rear edge, a rear corner a side edge portion of said blank, adjacent each side edge, being foldable upwardly such that said side edge portions each define a respective side wall member, said planar base is connected to each side wall member by a respective fold line, said fold lines are parallel to each other, each said side edge defines the top edge of a respective side wall member, each side wall member comprises a said front corner and a said rear corner, and each of the side wall members has a height such that the top edge thereof is flush with or extends above the tops of the adjacent containers, said kit being characterized in that each side edge portion is a corrugated member comprising a plurality of parallel corrugation flutes, said flutes being disposed such that when the side edge portion is folded upwardly the flutes thereof extend from a respective fold line to a respective said top edge, and said blank includes tongue-slot combination means disposed at each said corner, each tongue-slot combination means comprising edge slot means for engaging a surrounding band member for holding the carton containers in the U-shaped envelope, said edge slot means thereof being disposed adjacent to a respective side edge of said blank, said slot means thereof having a bottom and cushion tongue means for projecting from said edge slot means, each said tongue-slot combination means being disposed and configured such that when the surrounding band member is positioned in the edge slot means thereof, and is under tension to hold the carton containers in said U-shaped envelope, the uncovered side of an adjacent end container is flush with or extends outwardly beyond the bottom of the slot means thereof, each said tongue-slot combination means being disposed and configured such that when the surrounding band means is positioned in the edge slot means thereof, and is under tension to hold the carton containers in said U-shaped envelope, the band member extends across said uncovered sides of the U-shaped envelope and over and along the side wall members thereof, and each said tongue-slot combination means being disposed and configured such that the cushion tongue means thereof can be positioned so that when the surrounding band means is positioned in the edge slot means thereof, and is under tension to hold the carton containers in said U-shaped envelope, the cushion tongue means thereof is in underlying relation to said band member and engages an upper side edge portion of an uncovered side of a respective adjacent carton container.

7. A kit as defined in claim 6 wherein the blank is of corrugated cardboard comprising a plurality of parallel corrugation flutes, said flutes being disposed such that they extend from one said side edge to the other said side edge, said flutes being disposed such that when the side edge portions are folded upwardly the flutes thereof extend from a respective fold line to a respective said top edge orthogonally with respect to the respective fold line.

8. A kit as defined in claim 6 wherein each said tongue-slot combination means disposed at a front corner is defined by a pair of opposed cuts in the blank, said cuts extending from the front edge, adjacent to a respective side edge, wherein each said tongue-slot combination means disposed at a rear corner is defined by a pair of opposed cuts in the blank, said cuts extending from the rear edge, adjacent to a respective side edge, wherein said slot means has two opposed side edges extending from the bottom thereof, wherein said tongue means has two opposed side edges, wherein each said pair of opposed cuts define the side edges of both the tongue means and the slot means, and wherein the tongue means is foldable such that when the surrounding band member is positioned in the slot means and is under tension to hold the carton containers in said U-shaped envelope, the tongue means projects from the slot means in underlying relation to said band member, the tongue means engages an upper side edge portion of an uncovered side of a respective adjacent carton container and the tongue means is connected to the bottom of the slot means by a fold line.

9. A kit as defined in claim 6 wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means is defined by a cut in the blank, said cut being configured such that the tongue means is attached to the blank by a root member, said cut and root member being configured such that the tongue means is registrable with the slot means, and wherein said tongue means is foldable such that when the surrounding band member is positioned in the slot and is under tension to hold the carton containers in said U-shaped envelope, the tongue means is folded around the root member over the bottom of the slot means, the tongue means projects from the slot means in underlying relation to said band member, and the tongue means engages an upper side edge portion of an uncovered side of a respective adjacent carton container.

10. A kit as defined in claim 6 wherein each said tongue-slot combination means disposed at a front corner comprises slot means having two opposed side edges, said opposed side edges of the slot means extending from the bottom thereof to the front edge, adjacent to a respective side edge of the blank, wherein each said tongue-slot combination means disposed at a rear corner comprises slot means having two opposed side edges, said opposed side edges of the slot means extending from the bottom thereof to the rear edge, adjacent to a respective side edge of the blank, wherein each said tongue means comprises an elongated member attached to the blank, wherein said elongated member is disposed and configured so as to have an end portion registrable with the slot means, and wherein said elongated member is foldable such that when the surrounding band member is positioned in the slot and is under tension to hold the carton containers in said U-shaped envelope, the end portion of the elongated member is folded over the bottom of the slot means, the end portion of the elongated member projects from the slot means in underlying relation to said band member, and the end portion of the elongated member engages an upper side edge portion of an uncovered side of a respective adjacent carton container.

11. A container package comprising a U-shaped support envelope, a plurality of rectangular carton containers, and a surrounding band member, said plurality of rectangular carton containers being of uniform height, shape and size, said containers each having a top, a bottom and sides, said U-shaped support envelope having an uncovered top, two opposed uncovered sides, and two opposed, parallel, planar side wall members extending upwardly from a planar base, each said side wall member having a top edge, said carton containers being arranged in said U-shaped envelope in juxtaposed upright manner, in a plurality of parallel rows parallel to the said wall members and in a plurality of parallel rows orthogonal to the said side wall members, each side wall member abutting an adjacent row of said carton containers parallel thereto, each row of said carton containers, extending parallel to the side wall members, having a pair of end containers each of which has an uncovered side, said surrounding band member being held under tension and extending across said uncovered sides of the end carton containers and over and along said side wall members, the band holding the carton containers in the U-shaped envelope, characterized in that said U-shaped envelope comprises a front edge, a rear edge and two top edges, each top edge defining with the front edge a front corner each top edge defining with the rear edge a rear corner each side wall member comprises a said top edge, a said front corner and a said rear corner, each of the side wall members has a height such that the top edge thereof is flush with or extends above the tops of the each side wall member being a corrugated member comprising a plurality of parallel corrugation flutes extending upwardly from the base to a respective top edge of the side wall member, said U-shaped envelope including a tongue-slot combination means disposed at each said corner of the side wall members, each tongue-slot combination means comprising edge slot means engaging said band member, said edge slot means being disposed adjacent to a respective side edge, said edge slot means thereof having a bottom, and cushion tongue means projecting from said edge slot means and engaging an upper side edge portion of an uncovered side of a respective adjacent carton container, each said cushion tongue means being in underlying relation to said band member, and the uncovered side of each end container adjacent to a respective slot means is flush with or extends outwardly beyond the bottom of said slot means.

12. A container package as defined in claim 11 wherein the U-shaped envelope is of corrugated cardboard and the base comprises a plurality of parallel corrugation flutes, said flutes being disposed such that they extend from one said side wall member to the other said side wall member.

13. A container package as defined in claim 11 wherein each said tongue-slot combination means disposed at a front corner comprises slot means having two opposed side edges, said opposed side edges of the slot means extending from the bottom thereof to the front edge, adjacent to a respective side edge of the side wall member, wherein each said tongue-slot combination means disposed at a rear corner comprises slot means having two opposed side edges, said opposed side edges of the slot means extending from the bottom thereof to the rear edge, adjacent to a respective side edge of the side wall member, and wherein the tongue means projects from the slot means in underlying relation to said band member, the tongue means engages an upper side edge portion of an uncovered side of a respective adjacent carton container and the tongue means is connected to the bottom of the slot means by a fold line.

14. A container package as defined in claim 11 wherein each said tongue-slot combination means disposed at a front corner comprises slot means having two opposed side edges, said opposed side edges of the slot means extending from the bottom thereof to the front edge, adjacent to a respective side edge of the side wall member, wherein each said tongue-slot combination means disposed at a rear corner comprises slot means having two opposed side edges, said opposed side edges of the slot means extending from the bottom thereof to the rear edge, adjacent to a respective side edge of the side wall member, wherein each said tongue means is attached to the side wall member by a root member and wherein the tongue means is folded around the root member over the bottom of the slot means, the tongue means projects from the slot means in underlying relation to said band member, and the tongue means engages an upper side edge portion of an uncovered side of a respective adjacent carton container.

15. A container package as defined in claim 11 wherein each said tongue-slot combination means disposed at a front corner comprises slot means having two opposed side edges, said opposed side edges of the slot means extending from the bottom thereof to the front edge, adjacent to a respective side edge of the side wall member, wherein each said tongue-slot combination means disposed at a rear corner comprises slot means having two opposed side edges, said opposed side edges of the slot means extending from the bottom thereof to the rear edge, adjacent to a respective side edge of the side wall member, wherein each said tongue means comprises an elongated member attached to the side wall member, wherein said elongated member has an end portion, and wherein the end portion of the elongated member is folded over the bottom of the slot means, the end portion of the elongated member projects from the slot means in underlying relation to said band member, and the end portion of the elongated member engages an upper side edge portion of an uncovered side of a respective adjacent carton container.

16. A blank for forming a U-shaped support envelope for a container package containing rectangular carton containers of uniform height, shape and size, said containers each having a top, a bottom and sides, said U-shaped support envelope having an uncovered top, two opposed uncovered sides, and two opposed planar side wall members extending from a planar base, each said side wall member having a top edge, said blank being substantially rectangular and comprising a front edge, a rear edge and two side edges, each side edge defining with the front edge, a front corner each side edge defining with the rear edge, a rear corner a side edge portion of said blank, adjacent each side edge, being foldable upwardly such that said side edge portions each define a respective side wall member, said planar base is connected to each side wall member by a respective fold line, said fold lines are parallel to each other, each said side edge defines the top edge of a respective side wall member, each side wall member comprises a said front corner and a said rear corner, and each of the side wall members has a height such that the top edge thereof is flush with or extends above the tops of the adjacent containers, characterized in that said blank includes tongue-slot combination means disposed at each said corner, each tongue-slot combination means comprising edge slot means for engaging a surrounding band member for holding the carton containers in the U-shaped envelope, said edge slot means thereof being disposed adjacent to a respective side edge of said blank, said edge slot means thereof having a bottom, and cushion tongue means for projecting from said edge slot means, each said tongue-slot combination means being disposed and configured such that when the surrounding band member is positioned in the edge slot means thereof, and is under tension to hold the carton containers in said U-shaped envelope, the uncovered side of an adjacent end container is flush with or extends outwardly beyond the bottom of the slot means thereof, each said tongue-slot combination means being disposed and configured such that when the surrounding band member is positioned in the edge slot means thereof, and is under tension to hold the carton containers in said U-shaped envelope, the band member extends across said uncovered sides of the U-shaped envelope and over and along the side wall members thereof, and each said tongue-slot combination means being disposed and configured such that the cushion tongue means thereof can be positioned so that when the surrounding band member is positioned in the edge slot means thereof, and is under tension to hold the carton containers in said U-shaped envelope, the cushion tongue means thereof is in underlying relation to said band member and engages an upper side edge portion of an uncovered side of a respective adjacent carton container.

17. A container package comprising a U-shaped support envelope, a plurality of rectangular carton containers, and a surrounding band member, said plurality of rectangular carton containers being of uniform height, shape and size, said containers each having a top, a bottom and sides, said U-shaped support envelope having an uncovered top, two opposed uncovered sides, and two opposed, parallel, planar side wall members extending upwardly from a planar base, each said side wall member having a top edge, said carton containers being arranged in said U-shaped envelope in juxtaposed upright manner, in a plurality of parallel rows parallel to the said wall members and in a plurality of parallel rows orthogonal to the said side wall members, each side wall member abutting an adjacent row of said carton containers parallel thereto, each row of said carton containers, extending parallel to the side wall members, having a pair of end containers each of which has an uncovered side, said surrounding band member being held under tension and extending across said uncovered sides of the end carton containers and over and along said side wall members, the band holding the carton containers in the U-shaped envelope, characterized in that said U-shaped envelope comprises a front edge, a rear edge and two top edges, each top edge defining with the front edge a front corner each top edge defining with the rear edge a rear corner each side wall member comprises a said top edge, a said front corner and a said rear corner, each of the side wall members has a height such that the top edge thereof is flush with or extends above the tops of the adjacent containers, said U-shaped envelope including a tongue-slot combination means disposed at each said corner of the side wall members, each tongue-slot combination means comprising edge slot means engaging said band member, said edge slot means being disposed adjacent to a respective side edge, said edge slot means thereof having a bottom, and cushion tongue means projecting from said edge slot means and engaging an upper side edge portion of an uncovered side of a respective adjacent carton container, each said cushion tongue means being in underlying relation to said band member, and the uncovered side of each end container adjacent to a respective slot means is flush with or extends outwardly beyond the bottom of said slot means.

* * * * *